US007060950B1

(12) United States Patent
Harita

(10) Patent No.: US 7,060,950 B1
(45) Date of Patent: Jun. 13, 2006

(54) HEATING ELEMENT, A THAWING MAT AND A HOT MAT COMPRISING THE HEATING ELEMENT

(76) Inventor: Masaaki Harita, 1354, Senoo, Imaichi-shi, Tochigi-Ken (JP)

( * ) Notice: Subject to any disclaimer, the term of this patent is extended or adjusted under 35 U.S.C. 154(b) by 0 days.

(21) Appl. No.: 11/075,717

(22) Filed: Mar. 10, 2005

(51) Int. Cl.
*H05B 3/34* (2006.01)

(52) U.S. Cl. ..... 219/549; 219/211; 219/212; 219/528; 219/529; 219/536; 219/544; 219/545

(58) Field of Classification Search ..... 219/528–29, 219/536–539, 541, 544–545, 211–212, 217, 219/549
See application file for complete search history.

(56) References Cited

U.S. PATENT DOCUMENTS 5,720,774 A * 2/1998 Glucksman ..... 607/96
6,194,692 B1 * 2/2001 Oberle ..... 219/543

* cited by examiner

*Primary Examiner*—Shawntina Fuqua
(74) *Attorney, Agent, or Firm*—Griffin & Szipl, P.C.

(57) ABSTRACT

The invention provides a linear and/or plane heating element, and a thawing mat, and a hot mat comprising the linear and/or plane heating element that provides necessary heat quantity at low electric power without burning fossil fuel and the like. A heating element is provided produced by coating laminated polyester on a plane painted by paint that adds nickel-indium compound oxide to the upper surface of polyester film to solderlessly connect electrodes to both ends to connect a power supply to the electrodes. The present invention provides a thawing mat and hot mat that entirely and uniformly coat the heating element having high conductivity and heating efficiency by adding nickel-indium compound oxide having high conductivity and heating efficiency to thermally deposit. Thus, maintenance cost and electricity expense can be saved, and both high quality and social cost can be achieved.

7 Claims, 3 Drawing Sheets

HEATING ELEMENT, A THAWING MAT AND A HOT MAT COMPRISING THE HEATING ELEMENT

FIELD OF THE INVENTION

The present invention mainly relates to a thawing mat on the road and sidewalk, roof, or a hot mat to be used for heating or lagging.

BACKGROUND OF THE INVENTION

Conventionally, a plane heating element comprises a constituent that generates heat by electrical resistance and it is used for thawing or heating and the like. For example, there is one comprising a constituent that consists of carbon, metal powder and synthetic resin binder.

It is well-known method to underground a plane heating element for thawing to heat by electric energy using Nichrome wire. Furthermore, there is another method for heating and thawing that circulate hot water heated by burning water passing through underground pipes with gas.

However, they are only used at very small area of the limited space because not only maintenance cost is expensive, but also the breakdown such as breaking and the like often occurs and electricity expenses are expensive.

As above, at the aforementioned conventional plane heat element, there are problems that their heat value, thermal distribution, and thermal characteristic are poor and their service life is short, and that their capacity is poor at the parking, stairs, slopes and the like in the shade, or snowbelt, cold region.

A object of the present invention is to provide a thawing mat and a hot mat that can thaw and heat the road, sidewalk, roof and the like adequately and that can achieve uniform thermal distribution all over the plane, by laying down the linear and/or plane heating element.

SUMMARY OF THE INVENTION

The present invention is made by going through to study and device inventively to develop the plane heating element that can prevent from breaking and reduce the electricity expenses. The present invention provides a thawing mat and a hot mat that the linear and/or the plane heating element uniformly and entirely generate heating, which is formed by connecting electrodes to the both ends of the linear and/or plane heating element coated with laminated polyester on the plane spray-painted by paint that added nickel-indium compound oxide having high conductivity to the upper surface of polyester film, and being covered with natural rubber, synthetic rubber, vinyl chloride resin, glass fiber reinforced plastic and the like.

Typically, the oxide, metal, carbide, nitride and the like are used as conductive materials, however they can not be good conductive membrane. Furthermore, pekovskite of oxide system, tin oxide system doped antimony are conductive materials, however generally they are used for preventing from electrification, not for a heating element.

The heating element has nature that the chemical purity is high, the size of particle is proper, and the surface of the particle is difficult to degenerate. It is the heating elements painted by paint added nickel-indium compound oxide having high conductivity. It is characteristic of generating heat at high temperature when an electron moves freely without localization and rising conductivity further by increasing a carrier electron to improve performance.

DESCRIPTION OF THE PREFERRED EMBODIMENT

With reference to the drawings, embodiments of the present invention will now be described.

Figure 1:
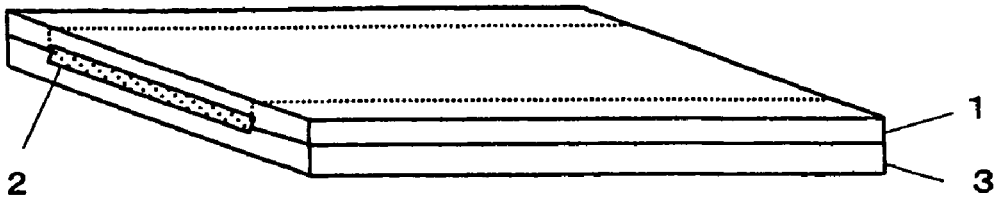
FIG. 1 is a perspective view of the heating element according to an embodiment of the present invention.
Figure 2:
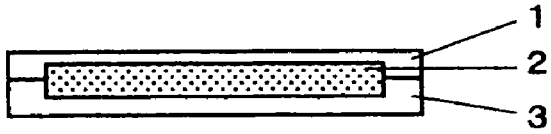
FIG. 2 is a sectional view of the heating element according to the embodiment of the present invention.
Figure 3:
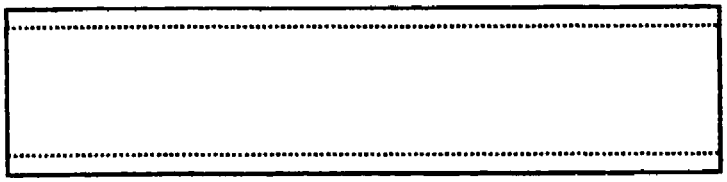
FIG. 3 is a plan view of the finished heating element according to the embodiment of the present invention.

FIGS. 1 to 3 show an embodiment of the linear and/or plane heating element formed on the plane. The FIG. 1 is a perspective view of the aspect, the FIG. 2 is a sectional view of the composition, and the FIG. 3 is a plan view of the finished heating element. This heating element is formed into the shape of 100m in length, 95 cm in width, and 10 μm–70 μm in thickness. This mat can be adjusted to any length, since this mat can be cut at initial set resistance and connect electrodes to the both ends by solderless processing after making it formed into the shape of 20 mm~500 mm in width and 100m in length by roll forming.

Figure 4:
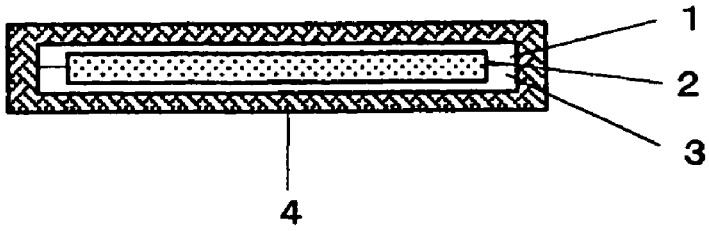
FIG. 4 is a sectional view of the rubber thawing mat and hot mat according to the embodiment of the present invention.
Figure 5:
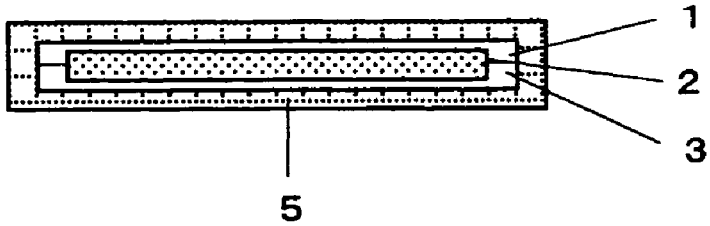
FIG. 5 is a sectional view of the vinyl chloride resin thawing mat and hot mat according to the embodiment of the present invention.
Figure 6:
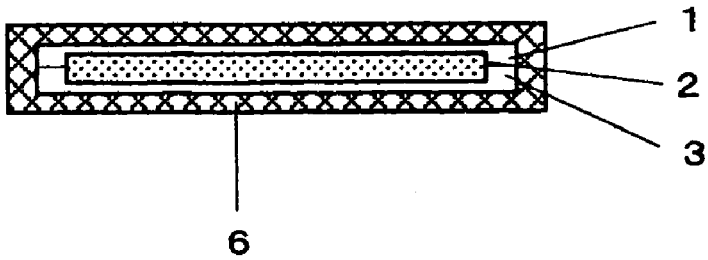
FIG. 6 is a sectional view of the glass fiber reinforced plastic thawing mat and hot mat according to the embodiment of the present invention.

FIGS. 4 to 6 show a sectional view of the thawing mat and hot mat comprising the linear and/or plane heating element. This thawing mat is one covered with natural rubber and synthetic rubber (the material of 30°~80° in JIS (Japan Industrial Standard) hardness is used to bear load), vinyl chloride resin, glass fiber reinforced plastic and the like all over the linear and/or plane heating element. Typically, the thawing mat is used in the shape of 10m in length, 50 cm in width, and 5 mm~7 mm in thickness. This mat can be adjusted to any length, since this mat can be cut at initial set resistance and connect electrodes to the both ends by solderless processing after making it formed into the shape of 2 cm~50 cm in width and 100m in length by roll forming. According to the above, it can be applied to many cases, for example, the thawing on the road, the heating in the kitchen, a hot mat, a hotbed for animals and the like.

Referring to the FIGS. 1 to 3, the linear and/or plane heating element is produced by being coated with laminated polyester films 1, 3 on the plane spray-painted by paint 2 that added nickel-indium compound oxide to a polyester film base 3 and processed by thermosetting to be insulated from heat. The heating membrane at that time is 7 μm~50 μm in thickness, and the thickness of the membrane changes according to temperature zone.

Figure 7:
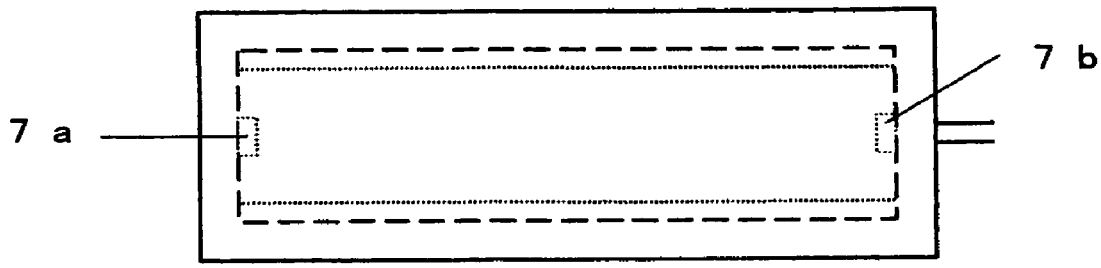
FIG. 7 is a plan view of the finished thawing mat and hot mat according to the embodiment of the present invention.
Figure 8:
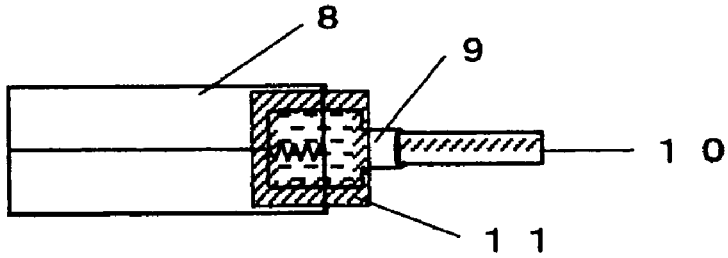
FIG. 8 is a side view of the electrode part 7*a*, 7*b* according to the embodiment of the present invention.
Figure 9:
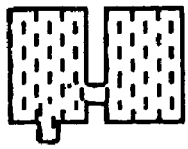
FIG. 9 is a diagram of the electrode terminal 9 according to the embodiment of the present invention.

The electrode terminals 9 shown in the FIG. 9 are connected to the both ends of the heating element 8 shown in the FIG. 3, and a wire 10 for power supply is connected to them. Then the electrode part 7*a* and 7*b* shown in the FIG. 7 is formed to generate resistance-heat according to the characteristic of the nickel-indium compound oxide after the wire is covered with insulating tape 11 as shown in FIG. 8.

Referring to the FIGS. 4 to 6, the thawing mat and plane mat comprising the linear and/or plane heating element will now be described. The thawing mat and hot mat comprising the heating element are produced by thermally depositing each material of natural rubber 4, synthetic rubber 4, vinyl chloride resin 5, glass fiber reinforced plastic 6 on the linear and/or plane heating element formed in one piece shown in the FIG. 2 which is set on each base of the material.

The heating element used in this thawing mat and hot mat generates heat according to the characteristic of the nickel-indium compound oxide. The temperature for generating heat is determined by the initial set resistance since the temperature zone changes at the area used. At that time, it can generate resistance-heat by fixed resistance set from 5 Ω to 150 Ω.

The thawing mat and hot mat comprising the linear and/or plane heating element have weather resistance and durability, and can be applied to not only thawing outside and heating but also the other many fields.

The following tables 1 and 2 indicate the characteristic of this heating element. Accordingly, the present invention can provide a thawing mat and hot mat for heating comprising heating element that heating efficiency is higher and consumed power is smaller than sheathe heater or the prior art plane heating element.

Table 1

Table 2

The linear and/or plane heating element and the thawing mat and hot mat comprising the linear and/or plane heating element according to the present invention are lightweight and easy to work, since their materials are thin and flexible. Furthermore, the present invention can provide not only thawing out snow around buildings that unnamed many people congregate such as a school, a hospital, a day-care center, road, and car park and the like, but also barrier-free effect in the various winter life.

TABLE 1

Characteristic of liner and plane heating element

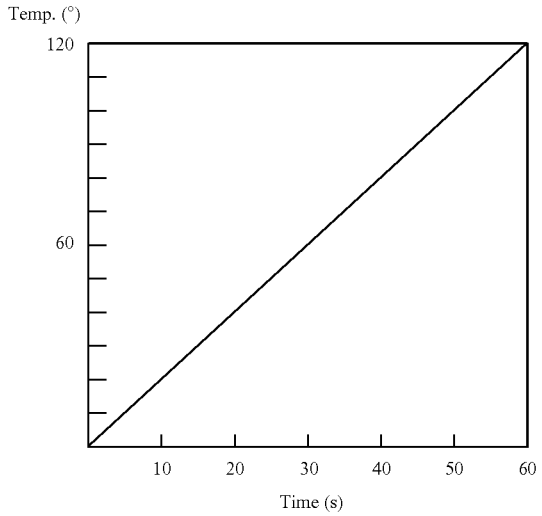

TABLE 2

Area vs. consumed power in the thawing mat and hot mat

| Voltage | Power | Area |
|---|---|---|
| 100 V | 60 W | 0.9 $m^2$ |
| 100 V | 125 W | 1.8 $m^2$ |
| 100 V | 250 W | 3.6 $m^2$ |

What is claimed is:

1. A heating element produced by coating laminated polyester by painting paint comprising nickel-indium compound oxide onto an upper surface plane of a polyester film thereby solderlessly connecting power supply electrodes at ends of the plane, wherein the heating element forms a heating membrane 7 μm to 50 μm in thickness.

2. A thawing mat and a heating mat comprising the heating element in accordance with claim 1, wherein an upper surface and a lower surface of the heating element are entirely covered with natural rubber and synthetic rubber.

3. A thawing mat and a heating mat comprising the heating element in accordance with claim 1, wherein an upper surface and a lower surface of the heating element are entirely covered with vinyl chloride resin.

4. A thawing mat and a heating mat comprising the heating element in accordance with claim 1, wherein an upper surface and a lower surface of the heating element are entirely covered with glass fiber reinforced plastic.

5. A heating element in accordance with claim 1, wherein the heating element generates heat linearly over time at a rate of 2° C. per second.

6. A thawing mat and heating mat comprising:

a heating element produced by coating laminated polyester by painting paint comprising nickel-indium compound oxide onto an upper surface plane of a polyester film thereby solderlessly connecting power supply electrodes at ends of the plane, wherein the heating element forms a heating membrane 7 μm to 50 μm in thickness; and an upper surface and a lower surface of the heating element is entirely covered by a material selected from the group consisting of natural rubber, synthetic rubber, vinyl chloride resin and glass fiber reinforced plastic, wherein the thawing mat and heating mat has an area to consumed power ratio of 0.014 to 0.015 $m^2$/W.

7. A thawing mat and heating mat in accordance with claim 6, wherein the heating element generates heat linearly over time at a rate of 2° C. per second.

* * * * *